US005826153A

United States Patent [19]

Hazama et al.

[11] Patent Number: 5,826,153

[45] Date of Patent: Oct. 20, 1998

[54] IMAGE-FORMING MACHINE

[75] Inventors: Hiroyuki Hazama; Eiichi Miyamoto; Hideo Nakamori; Takashi Terada; Masayuki Ishii; Takahiko Murata, all of Osaka, Japan

[73] Assignee: Mita Industrial Co., Ltd., Osaka, Japan

[21] Appl. No.: 962,773

[22] Filed: Nov. 3, 1997

[30] Foreign Application Priority Data

Nov. 18, 1996 [JP] Japan ..... 8-306598

[51] Int. Cl.[6] ..... G03G 21/00; A47L 13/40

[52] U.S. Cl. ..... 399/353; 399/111; 399/123; 399/343; 15/1.51

[58] Field of Search ..... 399/353, 354, 399/355, 343, 123, 111, 34; 15/1.51, 1.52, 256.5, 256.51, 256.52, 256.53, 256.6

[56] References Cited

U.S. PATENT DOCUMENTS 5,436,700 7/1995 Kikuchi et al. ..... 399/111
5,671,476 9/1997 Ishiguro et al. ..... 399/354

*Primary Examiner*—Arthur T. Grimley
*Assistant Examiner*—Hoan Tran
*Attorney, Agent, or Firm*—Beveridge, DeGrandi, Weilacher & Young, LLP

[57] ABSTRACT

An image-forming machine including a photosensitive drum which is rotatably disposed and successively passes through a charging zone, a developing zone and a transfer zone; a charger for charging the peripheral surface of the photosensitive drum into a predetermined polarity; a developing device for developing an electrostatic latent image formed on the peripheral surface of the photosensitive drum into a toner image; a transfer means for transferring the toner image formed on the peripheral surface of the photosensitive drum onto a transfer paper; and a foreign matter-recovering means which is disposed between the transfer zone and the charging zone and comes into contact with the peripheral surface of the photosensitive drum, and removes foreign matter adhered onto the peripheral surface of the photosensitive drum, the foreign matter-recovering means having a foreign matter-recovering brush brought into contact with the peripheral surface of the photosensitive drum, an elastic holding member made of an elastic material mounting said foreign matter-recovering brush, and a brush-support member for supporting said elastic holding member, and the foreign matter-recovering brush being press-contacted to the peripheral surface of the photosensitive drum by the compressive elastic force of the elastic holding member.

8 Claims, 4 Drawing Sheets

IMAGE-FORMING MACHINE

FIELD OF THE INVENTION

The present invention relates to an image-forming machine such as an electrostatic copier or a laser printer for developing an electrostatic latent image formed on a photosensitive layer of a photosensitive drum into a toner image and for transferring the toner image onto a transfer paper, and to a process unit used for the image-forming machine.

DESCRIPTION OF THE PRIOR ART

The image-forming machine of this type comprises a photosensitive drum which is rotatably disposed and successively passes through a charging zone, an electrostatic latent image-forming zone, a developing zone and a transfer zone; a charger disposed in the charging zone and electrically charges the peripheral surface of said photosensitive drum into a predetermined polarity; a developing device which is disposed in the developing zone and develops an electrostatic latent image formed on the peripheral surface of the photosensitive drum in the electrostatic latent image-forming zone into a toner image; and a transfer means which is disposed in the transfer zone and transfers the toner image formed on the peripheral surface of the photosensitive drum onto a transfer paper. Further, a foreign matter-recovering brush is disposed between the charging zone and the transfer zone and comes into contact with the peripheral surface of the photosensitive drum to remove foreign matter, such as paper dust and the like, adhered on the peripheral surface of the photosensitive drum. In order to effectively remove foreign matter, such as paper dust and the like, adhered on the peripheral surface of the photosensitive drum, the foreign matter-recovering brush must be maintained press-contacted with the peripheral surface of the photosensitive drum. To obtain a press-contacting force for the foreign matter-recovering brush, constitution has been employed in which the brush is relatively long and is resiliently deflected upon press-contact with the peripheral surface of the photosensitive drum, and the foreign matter-recovering brush is press-contacted to the peripheral surface of the photosensitive drum by the elastic force produced by the deflection.

As the length of the brush increases, however, the rigidity of the brush decreases resulting in a decrease in the capability for removing foreign matter, such as paper dust and the like, adhered to the peripheral surface of the photosensitive drum.

Moreover, it has been found that with the peripheral surface of the photosensitive drum being grounded via the foreign matter-recovering brush, not only the electric charge existing on the peripheral surface of the photosensitive drum is removed before it is electrically charged but also capability for removing foreign matter is enhanced. Here, in order to ground the peripheral surface of the photosensitive drum via the foreign matter-recovering brush, it is required to be so constituted that the brush itself is made of an electrically conductive material and it does not damage to the peripheral surface of the photosensitive drum.

It is desirable that the foreign matter-recovering brush has an electric resistance as small as possible in consideration of the grounding performance. In practice, however, the foreign matter-recovering brush is made of a synthetic resin such as rayon resin so will not damage the peripheral surface of the photosensitive drum, and the synthetic resin must contain carbon particles or the like in order to impart electrical conductivity to it. However, an increase in the content of carbon particles or the like for decreasing the electric resistance makes the foreign matter-recovering brush to become brittle and to lose durability. On the other hand, a decrease in the content of carbon particles or the like enables the durability to increase but the electric resistance to increase, whereby grounding performance is deteriorated resulting in the occurrence of a so-called fogging, that is, the transferred image becomes grayish as a whole.

SUMMARY OF THE INVENTION

It is a first object of the present invention to provide an image-forming machine equipped with a foreign matter-recovering means which produces a sufficient press-contacting force onto the peripheral surface of the photosensitive drum, and effectively removes foreign matter, such as paper dust and the like, adhered onto the peripheral surface of the photosensitive drum, and a process unit for the image-forming machine.

A second object of the present invention is to provide an image-forming machine equipped with a foreign matter-recovering means capable of grounding the peripheral surface of the photosensitive drum without damaging the peripheral surface of the photosensitive drum, and a process unit for the image-forming machine.

A third object of the present invention is to provide an image-forming machine equipped with a foreign matter-recovering means having a foreign matter-recovering brush which maintains durability without deteriorating the grounding performance for the peripheral surface of the photosensitive drum, and a process unit for the image-forming machine.

In order to accomplish the above-mentioned first object according to the present invention, there is provided an image-forming machine comprising a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; a transfer means which is disposed in said transfer zone and transfers the toner image formed on the peripheral surface of said photosensitive drum onto a transfer paper; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush brought into contact with the peripheral surface of said photosensitive drum, an elastic holding member made of an elastic material mounting said foreign matter-recovering brush, and a brush-support member for supporting said elastic holding member, said foreign matter-recovering brush being press-contacted to the peripheral surface of said photosensitive drum by on the compressive elastic force of said elastic holding member.

In order to accomplish the above-mentioned second object according to the present invention, there is provided an image-forming machine comprising a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; a transfer means which is disposed in said transfer zone and transfers the toner image formed on the peripheral surface of said photosensitive drum onto a transfer paper; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush which is made of an electrically conducting material and is brought into contact with the peripheral surface of said photosensitive drum, a flexible electrically conducting sheet member mounting said foreign matter-recovering brush, an elastic holding member made of an elastic material mounting said electrically conducting sheet member, a grounding member made of a metal member mounting said elastic holding member, and a brush-support member for supporting said grounding member, said electrically conducting sheet member being partly brought into contact with said grounding member.

In order to accomplish the above-mentioned third object according to the present invention, there is provided an image-forming machine comprising a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; a transfer means which is disposed in said transfer zone and transfers the toner image formed on the peripheral surface of said photosensitive drum onto a transfer paper; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush which is made of an electrically conducting material and is brought into contact with the peripheral surface of said photosensitive drum, an electrically conducting sheet member mounting said foreign matter-recovering brush, a grounding member mounting said electrically conducting sheet member, and a brush-support member for supporting said grounding member, said foreign matter-recovering brush having a volume resistivity that has been set to lie from $10^4$ to $10^8$ Ω·cm.

In order to accomplish the above-mentioned first object according to the present invention, furthermore, there is provided a process unit for an image-forming machine comprising, as a unitary structure, a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush brought into contact with the peripheral surface of said photosensitive drum, an elastic holding member made of an elastic material mounting said foreign matter-recovering brush, and a brush-support member for supporting said elastic holding member, and wherein said foreign matter-recovering brush being press-contacted to the peripheral surface of said photosensitive drum by the compressive elastic force of said elastic holding member.

In order to accomplish the above-mentioned second object according to the present invention, there is provided a process unit for an image-forming machine comprising, as a unitary structure, a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush which is made of an electrically conducting material and is brought into contact with the peripheral surface of said photosensitive drum, a flexible electrically conducting sheet member mounting said foreign matter-recovering brush, an elastic holding member made of an elastic material mounting said electrically conducting sheet member, a grounding member made of a metal member mounting said elastic holding member, and a brush-support member for supporting said grounding member, said electrically conducting sheet member being partly brought into contact with said grounding member.

In order to accomplish the above-mentioned third object according to the present invention, there is provided a process unit for an image-forming machine comprising, as a unitary structure, a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush which is made of an electrically conducting material and is brought into contact with the peripheral surface of said photosensitive drum, an electrically conducting sheet member mounting said foreign matter-recovering brush, a grounding member mounting said electrically conducting sheet member, and a brush-support member for supporting said grounding member, said foreign matter-recovering brush having a volume resistivity that has been set to lie from $10^4$ to $10^8$ Ω·cm.

Other features of the present invention will become obvious from the following description.

DETAILED DESCRIPTION OF THE PREFERRED EMBODIMENTS

Described below in detail with reference to the accompanying drawings is an image-forming machine and a process unit used for the image-forming machine constituted according to an embodiment of the present invention. Here, the illustrated embodiment deals with a printer as an image-forming machine that is constituted according to the present invention.

Figure 1:
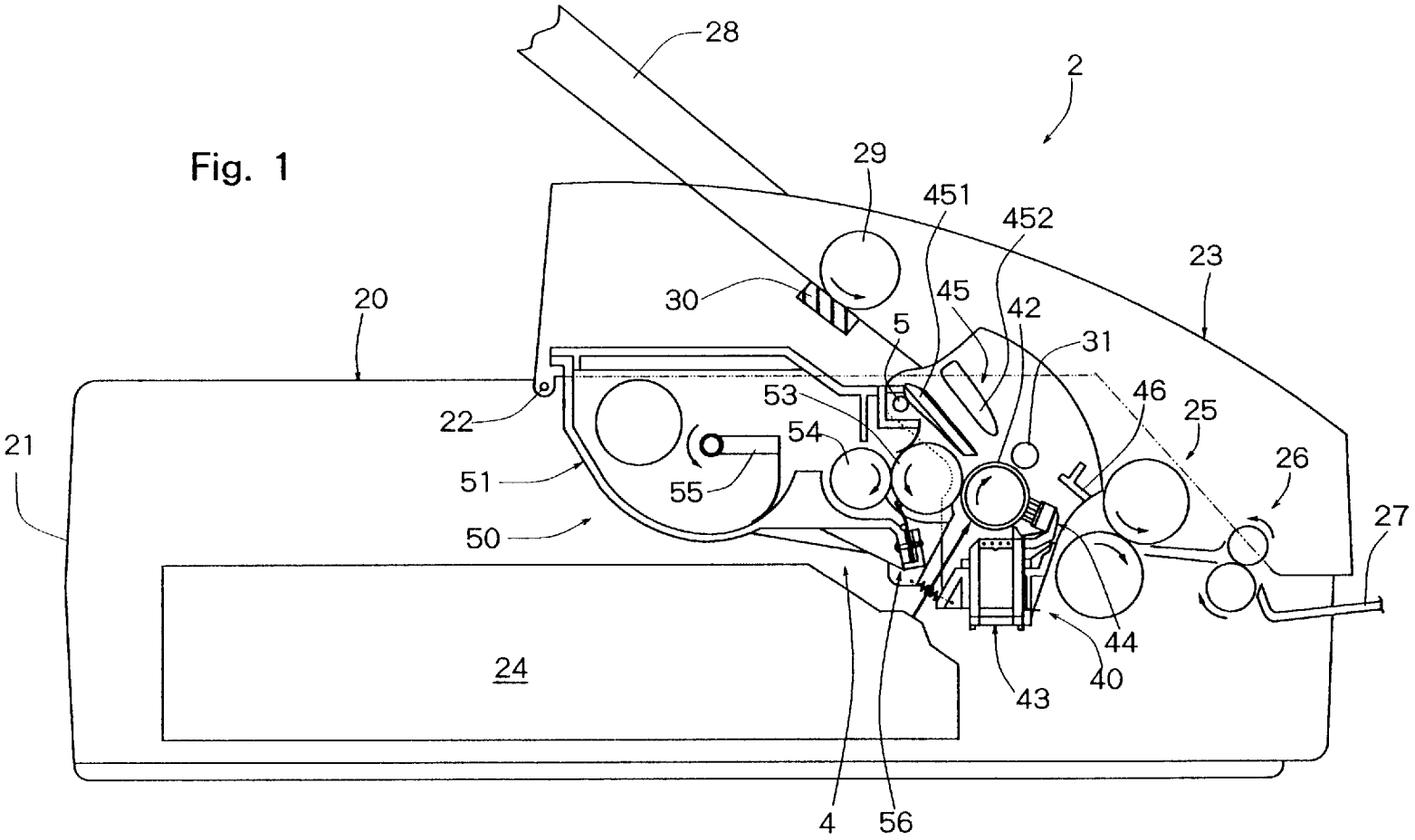
FIG. 1 is a front view schematically illustrating an image-forming machine constituted according to an embodiment of the present invention.

FIG. 1 schematically illustrates a printer constituted according to an embodiment of the present invention. In this embodiment, the printer 2 is a small-sized, low-speed laser printer used for a word processor and the like, and has a machine housing 20 formed by molding a plastic material. The machine housing 20 includes a box-shaped housing body 21 of which the upper side is open, and a cover 23 mounted to turn on a shaft 22 disposed at the upper part of the housing body 21. A process unit 4 is detachably mounted nearly in the central portion in the machine housing 20 constituted as described above.

Figure 2:
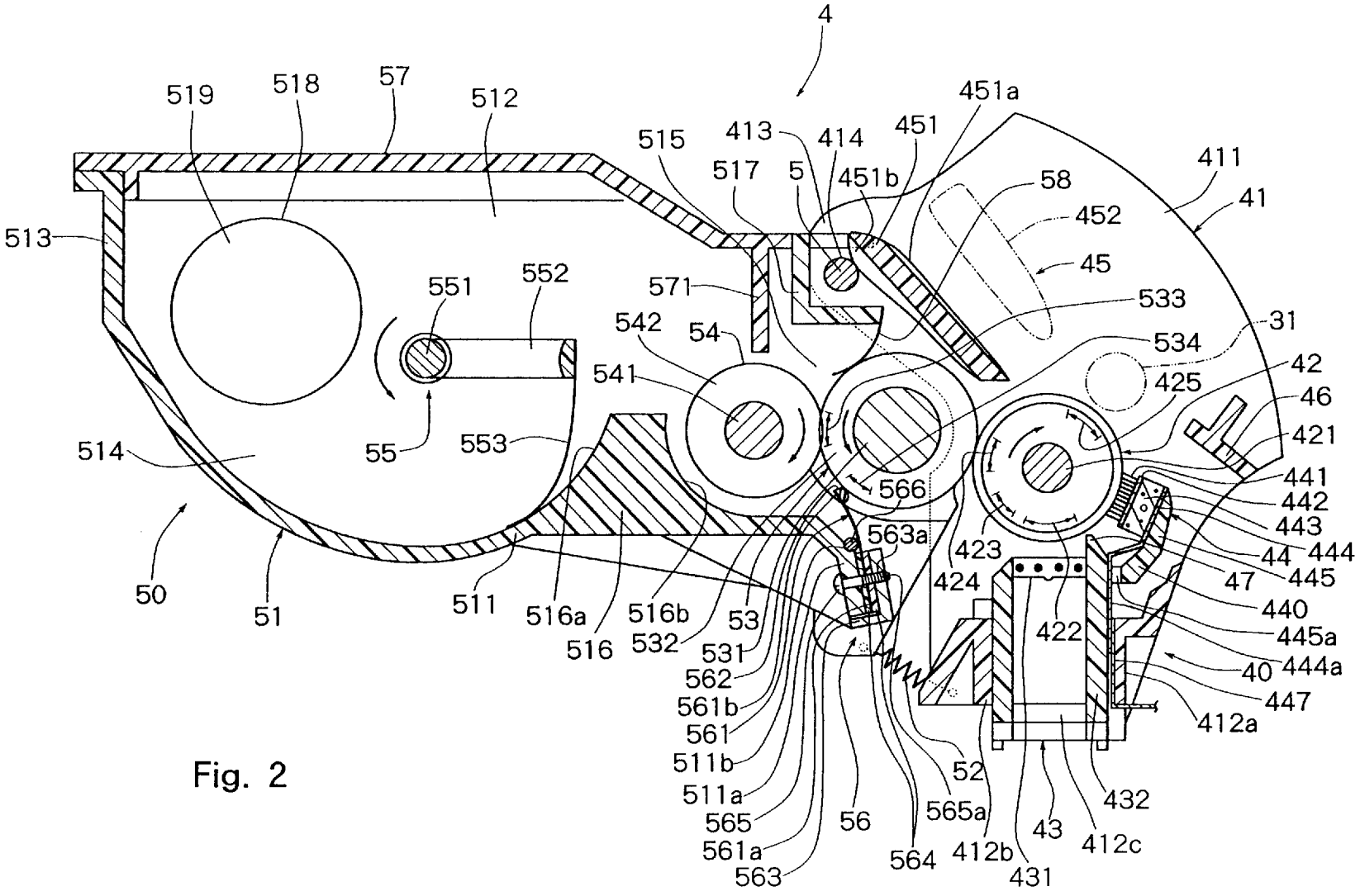
FIG. 2 is a sectional view of the image-forming machine constituted according to the present invention shown in FIG. 1.

The process unit 4, as shown in FIG. 2, has a photosensitive unit 40 and a developing unit 50 in which an electrostatic latent image developing device is formed as a unitary structure, the developing unit 50 being pivotally supported by the photosensitive unit 40 via a support shaft 5. The photosensitive unit 40 has a photosensitive drum support means 41. The photosensitive drum support means 41 has a pair of side wall members 411 (FIG. 2 illustrates the side wall member of the back side only) arranged, spaced from each other, in the back-and-forth direction, and coupling members 412*a* and 412*b* for coupling the lower portions of the pair of side wall members 411 together. The coupling members 412*a* and 412*b* have inner surfaces opposed to each other in parallel, and between these coupling members is formed a space 412*c* for mounting an electric charging means that will be described later. The space 412*c* for mounting an electric charging means is located being opposed to a charging zone that will be described later. The thus constituted photosensitive drum support means 41 is formed as a unitary structure by molding a plastic material. Support portions 413 having mounting holes 414 are provided at the upper end portions of the pair of side wall members 411 constituting the photosensitive drum support means 41 on the side of the developing unit 50. By inserting a support shaft 5 which is a metal rod disposed in a developing housing, that will be described later, of the developing unit 50 in the mounting holes 414 of the support portions 413, the photosensitive unit 40 and the developing unit 50 are supported to be allowed to turn relative to each other.

The photosensitive unit 40 has a photosensitive drum 42 having a photosensitive layer formed on the peripheral surface thereof. The photosensitive drum 42 has a rotary shaft 421 rotatably supported by the pair of side wall members 411 constituting the photosensitive drum support means 41, and is rotated by a drive means that is not shown in a direction of an arrow to pass successively through a charging zone 422, an electrostatic latent image-forming zone 423, a developing zone 424 and a transfer zone 425. In a charging means-mounting space 412*c* located in the charging zone 422 is mounted a charging means 43 that is opposed to the peripheral surface of the lower side of the photosensitive drum 42. The charging means 43 includes a corona discharger 431 arranged in parallel with the photosensitive drum 42 along the axial direction and working as an electric charger, and a charger-holding member 432 made of a plastic material to hold the corona discharger 431. The charging means 43 is placed in a predetermined position as the charger-holding member 432 is fitted to the charging means-mounting space 412*c*. The thus constituted charging means 43 electrically charges the peripheral surface of the photosensitive drum 42 to 800 to 850 V. Further, a foreign matter-recovering means 44 is disposed between the transfer zone 425 and the charging zone 422 to remove foreign matter, such as paper dust and the like, adhered onto the peripheral surface of the photosensitive drum 42.

Figure 3:
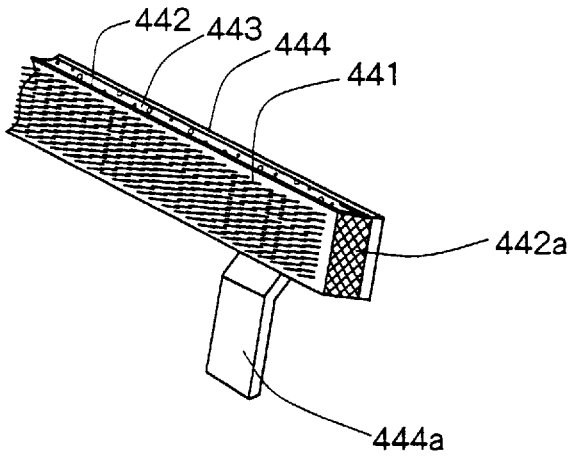
FIG. 3 is a perspective view illustrating a major portion of a foreign matter-recovering means mounted on the image-forming machine shown in FIG. 2.
Figure 4:
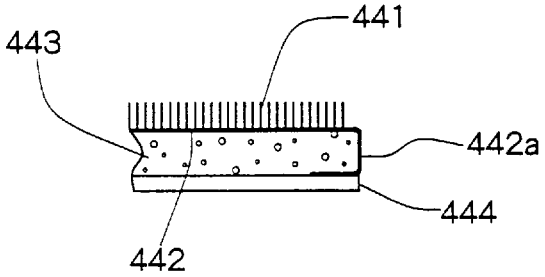
FIG. 4 is a sectional view illustrating a major portion of the foreign matter-recovering means shown in FIG. 3.

Next, the foreign matter-recovering means 44 will be described with reference also to FIGS. 3 and 4.

The foreign matter-recovering means 44 has nearly the same length as that of the photosensitive drum 42 in the axial direction thereof, and is equipped with a foreign matter-recovering brush 441 which is brought into contact with the peripheral surface of the photosensitive drum 42. In the illustrated embodiment, the foreign matter-recovering brush 441 is made of an electrically conducting material, such as a rayon resin, containing carbon particles and has a length of about 2 mm, and is mounted on an electrically conducting sheet member 442 having flexibility. The electrically conducting sheet member 442 is constituted by a woven fabric obtained by, for example, mix-spinning metal fibers. The above-mentioned foreign matter-recovering brush 441 is implanted onto the electrically conducting sheet member 442 constituted by this woven fabric. The electrically conducting sheet member 442 is mounted on a grounding member 444 via an elastic holding member 443. In the illustrated embodiment, the elastic holding member 443 is made of an elastic material such as sponge or the like and has a thickness of about 3 mm, and is adhered on its front surface and back surface to the electrically conducting sheet member 442 and the grounding member 444 using a suitable adhesive agent. The electrically conducting sheet member 442 has a tongue piece 442*a* provided at a front side end thereof. The tongue piece 442*a* is held between the grounding member 444 and the elastic holding member 443, and is adhered to the grounding member 444 using an electrically conducting adhesive. The grounding member 444 is constituted by a metal plate such as a stainless steel plate, and has a connection portion 444*a* that is downwardly protruding from a portion thereof. The thus constituted grounding member 444 is mounted, by using, for example, a double-sided adhesive tape, onto a brush-support member 445 that is formed integrally with the charger-holding member 432 and is arranged along the axial direction of the photosensitive drum 42. The connection portion 444*a* of the grounding member 444 is inserted in the charging means-mounting space 412*c* of the photosensitive drum support means 41 through an opening 445*a* formed in the brush-support member 445, and is brought into contact with an electrically conducting plate 447 disposed in the charging means-mounting space 412*c*. Therefore, the peripheral surface of the photosensitive drum 42 is grounded to the body through the foreign matter-recovering brush 441 constituted by the electrically conducting material, electrically conducting sheet member 442, grounding member 444 and electrically conducting plate 447. In the illustrated embodiment, the foreign matter-recovering means 44 is constituted as described above, and the force for press-contacting the foreign matter-recovering brush 441 onto the peripheral surface of the photosensitive drum 42 is obtained by compressing the elastic holding member 443. Therefore, there is no need to deflect the foreign matter-recovering brush for obtaining the press-contacting force. This makes it possible to shorten the length of the foreign matter-recovering brush 441, whereby the rigidity of the brush increases to exhibit enhanced performance for removing paper dust, etc. Moreover, the foreign matter-recovering brush 441 is connected to the grounding member 444 through the tongue piece 442*a* of the electrically conducting sheet member 442. Therefore, there is no likelihood that a member having high hardness comes into contact with the peripheral surface of the photosensitive drum 42, and hence, the peripheral surface of the photosensitive drum 42 is not damaged.

Figure 5:
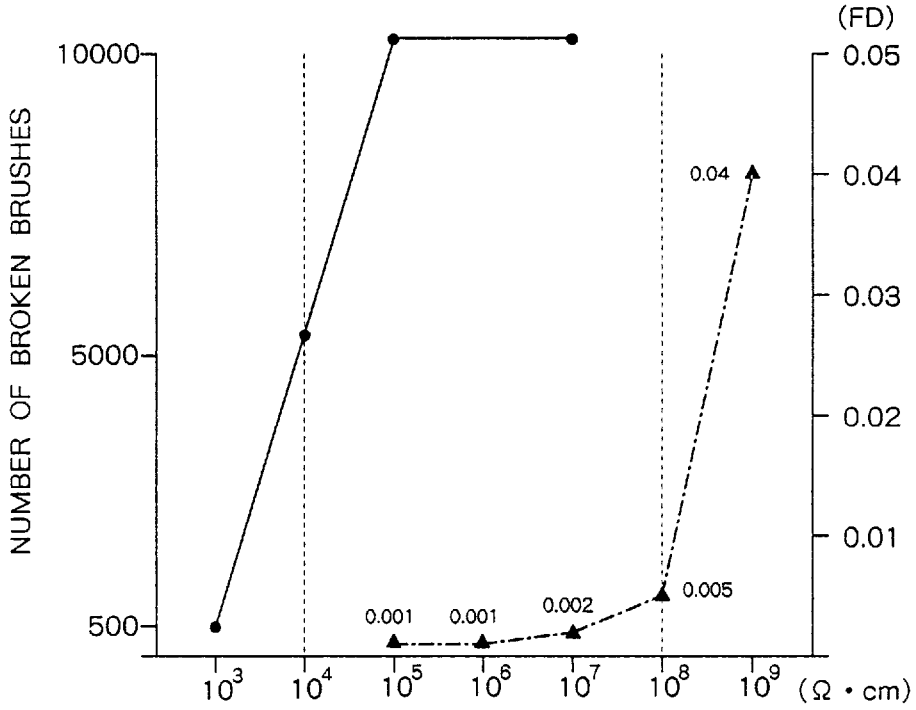
FIG. 5 is a diagram illustrating a relationship among the volume resistivity of the foreign matter-recovering brush constituting the foreign matter-recovering means of FIG. 3, breakage of the brush, and fogging density.

Next, described below is the electric resistance of the foreign matter-recovering brush 441. It is desired that the electric resistance of the foreign matter-recovering brush 441 is as small as possible from the standpoint of grounding performance. However, the foreign matter-recovering brush 441 is made of a synthetic resin such as a rayon resin so will not damage the peripheral surface of the photosensitive drum 42, and the synthetic resin must contain carbon particles or the like to have electrical conductivity. However, an increase in the content of carbon particles or the like to decrease the electric resistance makes the synthetic resin brittle and deteriorates the durability. The durability increases with a decrease in the content of carbon particles or the like causing, however, the electric resistance to increase, whereby the grounding performance decreases and the so-called fogging occurs, that is, the toner image becomes grayish as a whole. It is therefore desired that the foreign matter-recovering brush 441 has an electric resistance which lies within a predetermined range. The present inventors have prepared foreign matter-recovering brushes 441 having different volume resistances (Ω·cm), have conducted the operation for forming images using these foreign matter-recovering brushes 441, and have confirmed the number of the brushes that were broken and the so-called fogging density (FD) through experiment. FIG. 5 shows the results of experiment, wherein the abscissa represents the volume resistivity (Ω·cm) of the foreign matter-recovering brush 441 and the ordinate represents the number of papers at the occurrence of broken brushes and the so-called fogging density (FD). The foreign matter-recovering brush 441 having a volume resistivity of $10^3$ Ω·cm breaks after 500 copies of an A4-size manuscript are printed. The foreign matter-recovering brush 441 having a volume resistivity of $10^4$ Ω·cm breaks after not less than 5000 copies of the A4-size manuscript are printed. The foreign matter-recovering brush 441 having a volume resistivity of not smaller than $10^5$ Ω·cm does not break even after 10,000 copies of the A4-size manuscript are printed. When the brush breaks, not only the performance for removing paper dust and the like is deteriorated but also the broken brush adheres onto the corona discharger 431 for electric charging, whereby leakage takes place creating a cause of defective electric charging, or the broken brush that has adhered onto the peripheral surface of the photosensitive drum 42 gives rise to the occurrence of defective image, which is called black streaks. The fogging density (FD) is 0.001 when the foreign matter-recovering brush 441 has a volume resistivity of $10^5$ Ω·cm or $10^6$ Ω·cm, is 0.002 when the volume resistivity is $10^7$ Ω·cm, and is 0.005 when the volume resistivity is $10^8$ Ω·cm. It was revealed that the fogging density (FD) sharply rises to 0.40 when the volume resistivity of the foreign matter-recovering brush 441 reaches $10^9$ Ω·cm. It is generally thought that the image becomes defective when the fogging density (FD) becomes greater than 0.01. From the above-mentioned results of experiment, it is desired that the foreign matter-recovering brush 441 has a volume resistivity which is not smaller than $10^4$ Ω·cm so that it exhibits a durability to withstand until not less than 5000 copies are printed, and is not larger than $10^6$ Ω·cm so that the fogging density (FD) will not become larger than 0.01 which is a reference value.

Reverting to FIG. 2, the upper end of the charger-holding member 432 protrudes to approach the peripheral surface of the photosensitive drum 42 between the corona discharger 431 disposed in the charging zone 422 and the foreign matter-recovering brush 44, and constitutes a toner infiltration prevention wall 47. The toner infiltration prevention wall 47 works to prevent the toner from infiltrating onto the corona discharger 431 when the residual toner that is adhered on the peripheral surface of the photosensitive drum 42 and is removed by the foreign matter-recovering brush 441 together with foreign matter, such as paper dust and the like, is not trapped reliably but falls down. As a result, the toner which is prevented from moving by the toner infiltration prevention wall 47 deposits on a horizontal piece portion near the toner infiltration prevention wall 47 of the brush-support member 440.

Between the pair of side wall members 411 constituting the photosensitive drum support means 41 is disposed a lower guide plate 451 constituting one of a pair of pre-transfer guide plates 45 for guiding a transfer paper, which is fed from the upper left side in FIG. 2, toward the transfer zone 425 on the peripheral surface of the photosensitive drum 42. The lower guide plate 451 is molded integrally with the pair of side wall members 411. On the upper surface of the lower guide plate 451 are integrally formed a plurality of guide ribs 451*a* at regular intervals in the lengthwise direction (in a direction perpendicular to the surface of the paper in FIG. 2). The lower guide plate 451 further has, integrally formed on the lower surface thereof, a plurality of reinforcing ribs 451*b* at regular intervals in the lengthwise direction thereof (direction perpendicular to the surface of the paper in FIG. 2), the reinforcing ribs 451*b* being in contact with the support shaft 5. Therefore, the lower guide plate 451 is prevented from being deflected even when a pushing force is exerted on the upper surface thereof, because the reinforcing ribs 451*b* come into contact with the support shaft 5. Moreover, the lower guide plate 451 works as a coupling member for coupling together the upper portions of the pair of side wall members 411 constituting the photosensitive drum support means 41, and contributes to enhancing the rigidity of the photosensitive drum support means 41. In the illustrated embodiment, furthermore, since the lower guide plate 451 is integrally formed on the pair of side wall members 411, it can highly precisely maintain a positional relationship with respect to the photosensitive drum 42 that is rotatably supported by the pair of side wall members 411. In the illustrated embodiment, furthermore, the lower guide plate 451 also works as a member for preventing the contact with the photosensitive layer on the photosensitive drum 42 at the time when the process unit is attached or detached, works as a member for preventing the developing unit 50 from coming into contact with a developing roller that will be described later, and works to prevent the toner scattered from the surface of the developing roller from adhering onto the transfer paper or the passage for conveying the transfer paper.

Between the pair of side wall members 411 constituting the photosensitive drum support means 41 is disposed a post-transfer guide plate 46 for guiding the transfer paper, on which the toner image has been transferred in the transfer zone 425, to a fixing means that will be described later, the post-transfer guide plate 46 being integrally formed on the pair of side wall portions 411. Therefore, the post-transfer guide plate 46 works as a coupling member for coupling together the pair of side wall portions 411 that constitute the photosensitive drum support means 41, and enhances the rigidity of the photosensitive drum support means 41. The guide plate 46 in the illustrated embodiment also works for preventing the contact to the photosensitive layer of the photosensitive drum 42 at the time when the process unit is attached or detached.

Next, described below is the developing unit 50 which works as an electrostatic latent image developing device. The developing unit 50 in the illustrated embodiment is equipped with a developing housing 51 which holds a developing agent comprising a one-component toner. The developing housing 51 is constituted by a bottom wall 511, a front side wall 510 and a rear side wall 512 (the rear side wall only is shown in FIG. 2) erected upright from the front and rear ends (ends in a direction perpendicular to the surface of the paper in FIG. 2) of the bottom wall 511, and a left side wall 513. These walls are integrally formed by molding a plastic material, and define a stirrer chamber 514 and a developing chamber 515. On the bottom wall 511 constituting the developing housing 51 is integrally formed a partitioning wall 516 in the back-and-forth direction (direction perpendicular to the surface of the paper in FIG. 2) between the stirrer chamber 514 and the developing chamber 515. Both the right and left surfaces of the partitioning wall 516 are formed as arcuate guide surfaces 516*a* and 516*b*. Between the front and rear side walls 510, 512 constituting the developing housing 51 is provided a coupling member 517 at an upper part on the side of the developing chamber 515, integrally with the front and rear side walls 510, 512. A toner supply hole 518 is formed in the rear side wall 512 constituting the developing housing 51, and is fitted with a cap 519. At an upper end portion on the side of the developing chamber 515 of the thus constituted developing housing 51 is disposed the support shaft 5 penetrating through the front and rear side walls 510, 512. Both ends of the support shaft 5 are fitted to mounting holes 414 formed in the support portions 413 of the pair of side wall members 411 constituting the photosensitive drum support means 41 for supporting the photosensitive unit 40, so that the photosensitive unit 40 and the developing unit 50 are supported to turn relative to each other. Coil springs 52 that is a resilient means are interposed between the front end at the lower part of the photosensitive drum support means 41 for supporting the photosensitive unit 40 and the rear end at the lower part of the developing housing 51. Due to these coil springs 52, the photosensitive drum support means 41 and the developing housing 51 are energed to be drawn toward each other with the support shaft 5 as a fulcrum. The developing housing 51 is open at its upper side and right side, i.e., is open on the side of the photosensitive unit 40.

In the developing housing 51 are arranged a developing roller 53, a feeding roller 54, a stirrer means 55 and a developing agent-limiting means 56.

The developing roller 53 is disposed in the developing chamber 515 of the developing housing 51, and includes a rotary shaft 531 rotatably mounted on the front and rear side walls 510, 512 constituting the developing housing 51, and a solid synthetic rubber roller 532 secured to the outer peripheral surface of the rotary shaft 531. The rotary shaft 531 can be formed of a suitable metallic material such as stainless steel. The solid synthetic rubber roller 532 is composed of a relatively soft and electrically conducting material, e.g., an electrically conducting solid synthetic rubber such as an urethane rubber. In the illustrated embodiment, the solid synthetic rubber roller 532 has a surface roughness on the peripheral surface thereof, i.e., has a 10-point average roughness Rz of from 5.0 to 12.0 as measured in compliance with JIS B 0601. Furthermore, the solid synthetic rubber roller 532 has a volume resistivity of from about $10^4$ to about $10^9$ Ω·cm. In the illustrated embodiment, furthermore, the solid synthetic rubber roller 532 has a roller hardness or Asker C hardness of from 60 to 80. The thus constituted roller 532 of the developing roller 53 is exposed through the right-side opening formed in the developing housing 51, and is positioned being opposed to the photosensitive drum 42. The peripheral surface of the roller 532 constituting the developing roller 53 is press-contacted against the peripheral surface of the photosensitive drum 42 in the developing zone. In the thus pressed nip portion, the peripheral surface of the roller 532 is elastically compressed to some extent. The rotary shaft 531 of the developing roller 53 is driven by a drive means which is not shown in the direction of an arrow, i.e., from the lower side toward the upper side in the developing zone where the roller 532 and the photosensitive drum 42 are in contact with each other. With the rotation of the rotary shaft 531, the roller 532 is rotated in the direction of arrow, too, so that the peripheral surface of the roller 532 moves on successively a developing agent-holding zone 533, a developing agent-limiting zone 534 and a developing zone 424. In the illustrated embodiment, a constant voltage of 300 V is applied to the rotary shaft 531 of the developing roller 53.

The feeding roller 54 is disposed in the developing chamber 515 in the developing housing 51 in parallel with the developing roller 53, and includes a rotary shaft 541 rotatably mounted on the front and rear side walls 510, 512 constituting the developing housing 51, and a roller 542 secured to the outer peripheral surface of the rotary shaft 541. Like the rotary shaft 531, the rotary shaft 541 can be made of a suitable metallic material such as stainless steel. The roller 542 is made of a foamed material such as foamed silicone or foamed urethane. The roller 542 is pressed against the roller 532 of the developing roller 53 in the developing agent-holding zone 533 that is a nip portion constituted by the roller 542 and the developing roller 53. It is desired that the hardness of the foamed material constituting the roller 542 of the feeding roller 54 is considerably smaller (e.g., Asker C hardness of about 35) than the hardness of the roller 532 constituting the developing roller 53, and that the roller 542 is elastically compressed by about 0.1 to 0.6 mm in the nip region upon press-contacting the roller 542 with the roller 532 of the developing roller 53. The roller 542, too, has electrically conducting property and has a volume resistivity of about $10^2$ to $10^6$ Ω·cm. The rotary shaft 541 of the feeding roller 54 is driven by a drive means that is not shown in a direction indicated by an arrow, i.e., from the upper side toward the lower side in the developing agent-holding zone 533 that is a nip portion constituted by the roller 542 and the roller 532 of the developing roller 53. With the rotation of the rotary shaft 541, the roller 542 is rotated in the direction indicated by arrow. In the illustrated embodiment, a constant voltage of 450 V which is higher than the voltage applied to the developing roller 53 is applied to the rotary shaft 541 of the feeding roller 54.

There exists a relationship $V1<V2<V3$ among the peripheral velocity V1 of the photosensitive drum 42, peripheral velocity V2 of the developing roller 53, and peripheral velocity V3 of the feeding roller 54. In the illustrated embodiment, a relationship $1.2\ V1 \leqq V2 \leqq 2.5\ V1$ is set between the peripheral velocity V1 of the photosensitive drum 42 and the peripheral velocity V2 of the developing roller 53, and a relationship $1.0\ V2 \leqq V3 \leqq 2.0\ V2$ is set between the peripheral velocity V2 of the developing roller 53 and the peripheral velocity V3 of the feeding roller 54. When the peripheral velocity V2 of the developing roller 53 becomes smaller than 1.2 V1, the developing agent is not sufficiently supplied to the photosensitive drum 42 and hence, the image density decreases. When the peripheral velocity V2 of the developing roller 53 becomes smaller than 1.2 V1, the scraping action of the developing roller 53 decreases against the developing agent that is not transferred but remains adhered onto the photosensitive drum 42 after the transfer operation. As a result, there occurs a so-called offset fogging which is caused due to the presence of the not-transferred developing agent that remains adhered on the photosensitive drum 42. When the peripheral velocity V2 of the developing roller 53 becomes greater than 2.5 V1, on the other hand, the driving torque of the developing roller 53 is increased, and scattering of the developing agent is caused due to a centrifugal force. When the peripheral velocity V3 of the feeding roller 54 becomes smaller than 1.0 V2, the developing agent is not sufficiently supplied to the developing roller 53 and hence, the image density decreases. When the peripheral velocity V3 of the feeding roller 54 becomes smaller than 1.0 V2, only a small scraping action is produced by the feeding roller 54 for the peripheral surface of the developing roller 53. In case the developing agent without being transferred but is adhering to the photosensitive drum 42 after the transfer operation, adheres to the developing roller 53, therefore, it becomes difficult to remove the developing agent, i.e., the developing agent that remains adhered becomes a cause of so-called ghost phenomenon that appears in the developing of the next time. When the peripheral velocity V3 of the feeding roller 54 becomes greater than 2.0 V2, on the other hand, the feeding roller 54 to be driven requires an increased torque and consequently, the developing agent tends to stay on the upper side of the nip portion formed by the feeding roller 54 and the developing roller 53, resulting in an insufficient supply of the developing agent to the developing roller 53.

A stirrer means 55 is disposed in the stirrer chamber 514 of the developing housing 51. The stirrer means 55 is disposed in parallel with the feeding roller 54, and includes a rotary shaft 551 rotatably mounted on the front and rear side walls 510, 512 constituting the developing housing 51, a stirrer member 552 secured to the rotary shaft 551, and an elastic stirrer sheet member 553 mounted on the stirrer member 552. The stirrer member 552 is made of a plastic material, and has a plurality of openings in the lengthwise direction (direction perpendicular to the surface of the paper in FIG. 2). The stirrer sheet member 553 is made of a polyethylene terephthalate (PETP) resin having flexibility, and is secured with an adhesive to the front edge of the stirrer member 552. The thus constituted stirrer means 55 is continuously rotated by a drive means that is not shown in a direction indicated by an arrow in FIG. 2.

The developing agent-limiting means 56 has a flexible and elastic blade 561 that is press-contacted to the peripheral surface of the roller 532 constituting the developing roller 53. The limiting blade 561 is made of a stainless steel plate or a spring steel plate which is, for example, about 0.1 to 0.2 mm thick, and has nearly the same size as the length in the lengthwise direction of the roller 532 constituting the developing roller 53. The limiting blade 561 has a mounting portion 561*a* and a limiting portion 561*b*. A limiting member 562 made of an urethane rubber is mounted on the surface (of the side opposed to the developing roller 53) of the limiting portion 561*b* constituting the limiting blade 561. In the illustrated embodiment, the limiting member 562 has a semicircular shape in cross section with a radius of about 1 mm, has nearly the same length as the limiting blade 561 in the lengthwise direction, and is mounted on the surface of the limiting portion 561*b* at its flat portion with an adhesive. The mounting portion 561*a* of the limiting blade 561 is mounted, by using a holder plate 563, on a blade-mounting portion 511*a* provided at the open end of the bottom wall 511 constituting the developing housing 51 on the side of the photosensitive unit 40. In the illustrated embodiment, elastic members 564, 564 made of an urethane rubber sheet of about 0.2 to 0.3 mm in thickness are disposed between the mounting portion 561*a* of the limiting blade 561 and the holder plate 563 and between the mounting portion 561*a* and the blade-mounting portion 511*a* of the developing housing 51. A plurality of screw insertion holes are formed in the blade-mounting portion 511*a* of the developing housing 51, in the mounting portion 561*a* of the limiting blade 561, in the elastic members 564, 564 and in the holder plate 563 at their corresponding positions in the lengthwise direction at a predetermined distance. A plurality of screws 565 are inserted in the plurality of screw insertion holes formed in the above-mentioned members from the side of the blade-mounting portion 511*a* of the developing housing 51, and male screw portions 565*a* formed at the ends of the screws 656 are screwed into female screws 563*a* formed in the screw insertion holes of the holder plate 563, so that the mounting portion 561*a* of the limiting blade 561 is held by the holder plate 563 and is tightly secured to the blade-mounting portion 511*a* of the developing housing 51 via elastic members 564, 564. Thus, the mounting portion 561*a* of the limiting blade 561 is mounted on the blade-mounting portion 511*a* of the developing housing 51 via the elastic members 564, 564 and hence, the tightening force of the screws 565 is weakened by the elastic members 564, 564. Therefore, the holder plate 563 is not deformed so much despite it is not so rigid, and the limiting blade 561 hardly undergoes deformation of the holder plate 563 due to the tightening force of the screws 565. The illustrated embodiment has dealt with the case where the elastic members 564, 564 were arranged on both sides of the mounting portion 561*a* of the limiting blade 561. However, even when the elastic member 564 only is disposed between the mounting portion 561*a* of the limiting blade 561 and the holder plate 563, deformation of the limiting blade 561 is prevented to a sufficient extent though the tightening force is less weakened than when the elastic members are arranged on both sides.

On the upper side of the blade-mounting portion 511*a* of the developing housing 51 is formed a fulcrum member-mounting portion 511*b* in the back-and-forth direction (in a direction perpendicular to the surface of the paper in FIG. 2). In the illustrated embodiment, the fulcrum member-mounting portion 511*b* is formed by a groove of an arcuate shape in cross section. A fulcrum member 566 is disposed on the fulcrum member-mounting portion 511*b*. In the illustrated embodiment, the fulcrum member 566 is constituted by a metallic round rod of a diameter of, for example, 2 mm, and has a length nearly equal to that of the limiting plate 561 in the lengthwise direction. The fulcrum member 566 is placed on the fulcrum member-mounting portion 511*b*, and is brought into contact with the back surface (surface of the side opposite to the surface on which the limiting member 562 is mounted) between the mounting portion 561*a* of the limiting blade 561 and the limiting portion 561*b*. It is desired that the fulcrum member 566 is disposed at such a position that the contacting position of the limiting blade 561 is as remote as possible from the limiting member 562 from the standpoint of decreasing the size of the limiting blade 561. In the thus constituted developing agent-limiting means 56, the limiting blade 561 is deflected with the fulcrum member 566 as a fulcrum, and the limiting member 562 mounted on the surface of the limiting portion 561*b* is brought into pressed contact with the peripheral surface of the roller 532 that constitutes the developing roller 53, in the developing agent-limiting zone 534. The developing agent-limiting means 56 is constituted as described above, and the fulcrum member 566 which forms a fulcrum of deflection for the limiting blade 561 is constituted by a round rod, making it possible to obtain a fulcrum portion with a relatively good precision at a reduced cost. Though the illustrated embodiment has used a round rod as a fulcrum member 566, it is also allowable to use a square rod.

A closure 57 is mounted on the developing housing 51 for covering the open top thereof. The closure 57 is formed of a plastic material, and is secured with an adhesive to the upper surfaces of the front and rear side walls 510, 512, a left side wall 513 and a coupling member 517 that constitute the developing housing 51. On the inner surface of the closure 57, a limiting portion 571 is integrally formed at a position opposed to the feeding roller 54 to extend in the back-and-forth direction (direction perpendicular to the surface of the paper in FIG. 2) and to protrude toward the developing chamber 515. A predetermined distance is maintained between the lower end of the limiting portion 571 and the outer peripheral surface of the roller 542 constituting the feeding roller 54. In the illustrated embodiment, a sheet-like sealing member 58 is mounted on the coupling member 517 constituting the developing housing 51. The sheet-like sealing member 58 is constituted by a flexible sheet member formed of, for example, a polyethylene terephthalate (PETP) and has nearly the same length as that of the roller 532 constituting the developing roller 53 in the axial direction thereof. The sheet-like sealing member 58 is secured at its one end portion to the coupling member 517 by a securing means such as an adhesive, and is curved at its other end portion and is brought into resilient contact with the peripheral surface of the roller 532 constituting the developing roller 53. The thus constituted sheet-like sealing member 58 prevents the developing agent from scattering through the opening of the developing housing 51 on the side of the photosensitive unit 40 in cooperation with the blade 561 of the developing agent-limiting means 56.

As shown in FIG. 1, the thus constituted process unit 4 is detachably mounted on the machine housing 20 of the printer 2. That is, the cover 23 constituting the machine housing 20 of the printer 2 is turned counterclockwise on the shaft 22 in FIG. 1, whereby the upper side of the housing body 21 constituting the machine housing 20 is opened. Then, the process unit 4 is mounted in the housing body 21 from the upper side. In the housing body 21 is provided a positioning means (not shown) capable of placing the photosensitive unit 40 of the process unit 4 at a predetermined position. After the process unit 4 is mounted in the housing body 21 of the machine housing 20, the cover 22 is turned clockwise about the shaft 22 in FIG. 1, thereby to close the upper portion thereof.

Referring to FIG. 1, a laser unit 24 is disposed at the lower part of the housing body 21 which constitutes the machine housing 20 of the printer 2. The laser unit 24 projects a laser beam corresponding to print data from, for example, a word processor connected to the printer 2, onto the photosensitive layer of the photosensitive drum 42 in the electrostatic latent image-forming zone 423 in the process unit 4, thereby to form an electrostatic latent image. In the housing body 21 constituting the machine housing 20 of the printer 2 are disposed a pair of fixing rollers 25 on the downstream side of the post-transfer guide plate 46. On the downstream side of the pair of fixing rollers 25 are disposed a pair of discharge rollers 26. On the downstream side of the pair of discharge rollers 26 is further disposed a paper discharge tray 27.

Referring to FIG. 2, on the left upper part of the cover 23 constituting the machine housing 20 of the printer 2 is disposed a paper feed tray 28 on which will be placed the transfer papers. A paper feed roller 29 is disposed on the downstream side of the paper feed tray 28, and is driven by a drive means that is not shown in a direction indicated by an arrow in FIG. 1. A friction pad 30 for separating the papers is disposed being opposed to the paper feed roller 29. In the transfer zone 422, furthermore, a non-contact type transfer roller 31 is disposed being opposed to the photosensitive drum 42. The transfer roller 31 is formed of an electrically conducting foamed urethane and is rotatably supported by the cover 23. The transfer roller 31 has, at its both ends, collars (not shown) made of an insulating material such as a plastic material having an outer diameter larger than that of the transfer roller 31, the collars being brought into contact with the peripheral surface of the photosensitive drum 42. Therefore, the transfer roller 31 is driven in a slipping manner with the rotation of the photosensitive drum 42. A gap of about 0.5 mm is maintained between the peripheral surface of the transfer roller 31 and the peripheral surface of the photosensitive drum 42. A constant current of, for example, 10 $\mu$A is permitted to flow into the thus constituted transfer roller 31. Furthermore, an upper guide plate 452 constituting the other one of the pair of pre-transfer guide plates 45 is disposed in the cover 23.

The printer in the illustrated embodiment is constituted as described above. The actions will now be described.

Based on a print command from a word processor or the like that is not shown, the above-mentioned members start operating, and the photosensitive layer on the surface of the photosensitive drum 42 is charged substantially uniformly to a predetermined polarity by the corona discharger 43 for electric charging. Then, a laser beam of the laser unit 24 corresponding to the print data from the word processor or the like, is irradiated onto the surface of the charged photosensitive layer of the photosensitive drum 42, thereby to form an electrostatic latent image. The electrostatic latent image thus formed on the photosensitive layer of the photosensitive drum 42 is developed into a toner image by the developing action of the developing unit 50. The developing action of the developing unit 50 will be described later in detail. The transfer papers placed on the paper feed tray 28 are fed piece by piece by the action of the paper feed roller 29 and of the friction pad 30. The transfer paper is guided by the pair of pre-transfer guide plates 45, conveyed to between the photosensitive drum 42 and the transfer roller 31, and the toner image formed on the photosensitive drum 42 is transferred onto the surface of the transfer paper. The transfer paper onto which the toner image has been transferred is guided by the post-transfer guide plate 46 and is conveyed to the pair of fixing rollers 25. The transfer paper onto which the toner image has been heat-fixed by the pair of fixing rollers 25 is discharged by the pair of discharge rollers 26 onto the paper discharge tray 27. When the peripheral surface of the photosensitive drum 42 that has passed through the transfer zone 425 passes through the foreign matter-recovering brush 441 of the foreign matter-recovering means 44, foreign matters such as paper dust adhered to the peripheral surface thereof are removed by the foreign matter-recovering brush 441. At this moment, residual toner adhered to the peripheral surface of the photosensitive drum 42 is also removed together with foreign matters such as paper dust. The residual toner that is removed may not be reliably trapped by the foreign matter-recovering brush 44 but may fall frequently. The toner that has fallen and deposited on the corona discharger 431 could become a cause of irregular charging. In the illustrated embodiment, however, the toner that has fallen is prevented from infiltrating into the corona discharger 431 owing to the wall 47 for preventing the infiltration of toner.

The developing action of the developing unit 50 will be described next.

Upon starting the operation of the developing unit 50, the developing roller 53, feeding roller 54 and stirrer means 55 are rotated by a drive means that is not shown in the directions indicated by arrows. With rotation of the stirrer member 552 and the stirrer sheet member 553 constituting the stirrer means 55 in the direction indicated by an arrow, the developing agent contained in the stirrer chamber 514 is stirred, climbs over the partitioning wall 516, and is fed into the developing chamber 514 from the upper side of the feeding roller 54. Here, the limiting member 571 formed on the inner surface of the closure 57 so works that the developing agent will not be supplied in excess amounts into the developing chamber 514. The developing agent fed by the stirrer means 55 is put on the roller 542 of the feeding roller 54 and is conveyed to a nip portion which is the developing agent-holding zone 533. The feeding roller 54 and the developing roller 53 rotate in the same direction from the upper side toward the lower side in the developing agent-holding zone 533 which is the nip portion. Therefore, the developing agent is sufficiently supplied from the feeding roller 54 to the developing roller 53, without causing a short supply. Besides, the feeding roller 54 and the developing roller 53 rotate in the same direction in the developing agent-holding zone 533 which is the nip portion as described above, and hence, is reliably rotated without requiring a large driving force.

The developing agent conveyed to the developing agent-holding zone 533 which is the nip portion constituted by the feeding roller 54 and the developing roller 53 is held by the peripheral surface of the roller 532 that constitutes the developing roller 53 and is conveyed toward the developing agent-limiting zone 534. Here, the feeding roller 54 and the developing roller 53 rotate in the same direction from the upper side toward the lower side in the developing agent-holding zone 533 which is the nip portion. Accordingly, the developing agent passes through the nip portion constituted by the above two rollers, held by the developing roller 53, and is conveyed to the developing agent-limiting zone 534 and to the developing zone 424. Thus, the developing agent is rubbed as it passes through the nip portion and is electrically charged to a sufficient degree, making it possible to prevent the occurrence of so-called fogging.

In the developing agent-limiting zone 534, the limiting member 562 mounted on the surface of the blade 561 constituting the developing agent-limiting means 56, acts on the developing agent held on the peripheral surface of the roller 532 of the developing roller 53, so that the amount of the developing agent held on the peripheral surface of the roller 532 is limited to form a thin layer thereof. In the developing agent-limiting zone 534, the developing agent is limited by the limiting member 562 mounted on the blade 561 of the developing agent-limiting means 56 and is scraped off onto the bottom wall 511 of the developing housing 51. Here, since the feeding roller 54 is rotating in a direction indicated by an arrow, the developing agent is kept conveyed along the guide surface 516*b* of the partitioning wall 516.

As described above, the developing agent is held on the peripheral surface of the roller 532 constituting the developing roller 53 in the developing agent-holding zone 533 and is formed into a thin layer in the developing agent-limiting zone 534 by the action of the limiting member 562 mounted on the limiting blade 561 of the developing agent-limiting means 56. The developing agent is then conveyed to the developing zone 424 with the rotation in the direction of arrow.

In the developing zone 424, the developing agent is applied to the electrostatic latent image on the photosensitive material provided on the peripheral surface of the photosensitive drum 42, whereby the electrostatic latent image is developed into the toner image. For example, the electrostatic latent image has a non-image region charged to about +600 V and an image region charged to about +120 V, and the toner as the developing agent is adhered to the image region (so-called reversal development). The photosensitive drum 42 and the developing roller 53 are rotated in the directions indicated by arrows in FIG. 2. In the developing zone 424, therefore, the peripheral surface of the photosensitive drum 42 and the peripheral surface of the roller 532 constituting the developing roller 53 are both moved in the same direction from the lower side toward the upper side. The peripheral velocity V2 of the roller 532 and the peripheral velocity V1 of the photosensitive drum 42 have been so set as to maintain a relationship $1.2\ V1 \leqq V2 \leqq 2.5\ V1$. The developing agent is conveyed in a sufficient amount to the developing zone 535 by the roller 532 of the developing roller 53, and the developing agent once adhered to the non-image portion of the electrostatic latent image is suitably peeled off due to the rubbing action of the peripheral surface of the roller 532 against the peripheral surface of the photosensitive drum 42. It is therefore allowed to obtain a good toner image having a suitable developing density without fogging. On the other hand, the used developing agent that has passed through the developing zone 424 being held on the peripheral surface of the roller 532 constituting the developing roller 53, is transferred onto the surface of the feeding roller 54 at a nip portion constituted by the developing roller 53 and the feeding roller 54. Here, the peripheral velocity of the feeding roller 54 is greater than the peripheral velocity of the developing roller 53 and the developing agent is moved at the nip portion. Therefore, the adhering force of the non-transferred developing agent adhered to the developing roller 53 is weakened at the time when it passes through the developing zone 535, and the non-transferred developing agent is recovered. Thus, it is made possible to prevent the occurrence of so-called ghost caused by the non-transferred developing agent that remains adhered to the developing roller 53.

The present invention was described above by way of embodiments of when being applied to a printer. The invention, however, is in no way limited to the illustrated embodiments only but can be adapted to, for example, an electrostatic copier, and can be varied or modified in a variety of ways without departing from the technical spirit and scope of the invention.

The image-forming machine and the process unit used for the image-forming machine according to the present invention are constituted as described above, and exhibit actions and effects as described below.

That is, according to the present invention, the foreign matter-recovering means which is disposed between the transfer zone and the charging zone and comes into contact with the peripheral surface of the photosensitive drum to remove foreign matter adhered on the peripheral surface of the photosensitive drum, comprises a foreign matter-recovering brush brought into contact with the peripheral surface of the photosensitive drum, an elastic holding member made of an elastic material mounting said foreign matter-recovering brush, and a brush-support member for supporting said elastic holding member, and since said foreign matter-recovering brush is press-contacted to the peripheral surface of said photosensitive drum by the compressive elastic force of said elastic holding member, there is no need to deflect the foreign matter-recovering brush for obtaining the press-contacting force. This makes it possible to shorten the length of the foreign matter-recovering brush, whereby the rigidity of the brush increases, and enhanced performance is exhibited for removing paper dust and the like.

According to the present invention, furthermore, the foreign matter-recovering means comprises a foreign matter-recovering brush which is made of an electrically conducting material and is brought into contact with the peripheral surface of said photosensitive drum, a flexible electrically conducting sheet member mounting said foreign matter-recovering brush, an elastic holding member made of an elastic material mounting said electrically conducting sheet member, a grounding member made of a metal member mounting said elastic holding member, and a brush-support member for supporting said grounding member, and since said electrically conducting sheet member is partly brought into contact with said grounding member, a member having a high hardness does not come into contact with the peripheral surface of the photosensitive drum, and the peripheral surface of the photosensitive drum suffers from damage.

Moreover, according to the present invention, the foreign matter-recovering means comprises a foreign matter-recovering brush which is made of an electrically conducting material and is brought into contact with the peripheral surface of said photosensitive drum, an electrically conducting sheet member mounting said foreign matter-recovering brush, a grounding member mounting said electrically conducting sheet member, and a brush-support member for supporting said grounding member, and since said foreign matter-recovering brush has a volume resistivity that has been set to lie from $10^4$ to $10^8$ Ω·cm durability is maintained without deteriorating grounding performance of the foreign matter-recovering brush.

What we claim is:

1. An image-forming machine comprising a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; a transfer means which is disposed in said transfer zone and transfers the toner image formed on the peripheral surface of said photosensitive drum onto a transfer paper; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush brought into contact with the peripheral surface of said photosensitive drum, an elastic holding member made of an elastic material mounting said foreign matter-recovering brush, and a brush-support member for supporting said elastic holding member, said foreign matter-recovering brush being press-contacted to the peripheral surface of said photosensitive drum by the compressive elastic force of said elastic holding member.

2. An image-forming machine comprising a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; a transfer means which is disposed in said transfer zone and transfers the toner image formed on the peripheral surface of said photosensitive drum onto a transfer paper; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush which is made of an electrically conducting material and is brought into contact with the peripheral surface of said photosensitive drum, a flexible electrically conducting sheet member mounting said foreign matter-recovering brush, an elastic holding member made of an elastic material mounting said electrically conducting sheet member, a grounding member made of a metal member mounting said elastic holding member, and a brush-support member for supporting said grounding member, said electrically conducting sheet member being partly brought into contact with said grounding member.

3. An image-forming machine according to claim 2, wherein said electrically conducting sheet member is partly held between said grounding member and said elastic holding member, and is adhered to said grounding member with an electrically conducting adhesive agent.

4. An image-forming machine comprising a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; a transfer means which is disposed in said transfer zone and transfers the toner image formed on the peripheral surface of said photosensitive drum onto a transfer paper; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush which is made of an electrically conducting material and is brought into contact with the peripheral surface of said photosensitive drum, an electrically conducting sheet member mounting said foreign matter-recovering brush, a grounding member mounting said electrically conducting sheet member, and a brush-support member for supporting said grounding member, said foreign matter-recovering brush having a volume resistivity that has been set to lie from $10^4$ to $10^8$ Ω·cm.

5. A process unit for an image-forming machine comprising, as a unitary structure, a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush brought into contact with the peripheral surface of said photosensitive drum, an elastic holding member made of an elastic material mounting said foreign matter-recovering brush, and a brush-support member for supporting said elastic holding member, said foreign matter-recovering brush being press-contacted to the peripheral surface of said photosensitive drum by the compressive elastic force of said elastic holding member.

6. A process unit for an image-forming machine comprising, as a unitary structure, a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush which is made of an electrically conducting material and is brought into contact with the peripheral surface of said photosensitive drum, a flexible electrically conducting sheet member mounting said foreign matter-recovering brush, an elastic holding member made of an elastic material mounting said electrically conducting sheet member, a grounding member made of a metal member mounting said elastic holding member, and a brush-support member for supporting said grounding member, said electrically conducting sheet member being partly brought into contact with said grounding member.

7. A process unit for an image-forming machine according to claim 6, wherein said electrically conducting sheet member is partly held between said grounding member and said elastic holding member, and is adhered to said grounding member with an electrically conducting adhesive agent.

8. A process unit for an image-forming machine comprising, as a unitary structure, a photosensitive drum which is rotatably disposed and successively passes through a charging zone, an electrostatic latent image-forming zone, a developing zone and a transfer zone; a charger which is disposed in said charging zone and charges the peripheral surface of said photosensitive drum into a predetermined polarity; a developing device which is disposed in said developing zone, and develops an electrostatic latent image formed on the peripheral surface of said photosensitive drum in said electrostatic latent image-forming zone into a toner image; and a foreign matter-recovering means which is disposed between said transfer zone and said charging zone and comes into contact with the peripheral surface of said photosensitive drum, and removes foreign matter adhered onto the peripheral surface of said photosensitive drum;

wherein said foreign matter-recovering means comprises a foreign matter-recovering brush made of an electrically conducting material and is brought into contact with the peripheral surface of said photosensitive drum, an electrically conducting sheet member mounting said foreign matter-recovering brush, a grounding member mounting said electrically conducting sheet member, and a brush-support member for supporting said grounding member, said foreign matter-recovering brush having a volume resistivity that has been set to lie from $10^4$ to $10^8$ Ω·cm.

* * * * *